US005228837A

United States Patent [19]

Shiffler et al.

[11] Patent Number: 5,228,837

[45] Date of Patent: Jul. 20, 1993

[54] HIGH PRESSURE PUMP FOR ELECTRO-RHEOLOGICAL FLUIDS

[75] Inventors: Mark E. Shiffler, Annapolis, Md.; Luke W. Loy, Washington, D.C.

[73] Assignee: The United States of America as represented by the Secretary of the Navy, Washington, D.C.

[21] Appl. No.: 953,338

[22] Filed: Sep. 30, 1992

[51] Int. Cl.[5] ..... F24B 37/02; F01C 1/18

[52] U.S. Cl. ..... 417/48; 418/206

[58] Field of Search ..... 417/48, 900; 418/206, 418/141

[56] References Cited

U.S. PATENT DOCUMENTS

| | | | |
|---|---|---|---|
| 3,275,225 | 9/1966 | Schultz | 418/206 X |
| 3,405,728 | 10/1968 | Dexter | 417/48 X |
| 3,640,650 | 2/1972 | Wydler | 418/206 |
| 4,493,615 | 1/1985 | Stangroom | 417/48 |

*Primary Examiner*—Richard E. Gluck

*Attorney, Agent, or Firm*—Charles D. Miller

[57] ABSTRACT

A high-pressure pump for electro-rheological fluids in which the pump components operate with relatively large clearances and rely on the electro-rheological fluid effect for sealing. Preferably, the electro-rheological effect is induced in the fluid only in the region where a seal between relatively merging pump parts is required to generate a fluid pressure increase.

2 Claims, 1 Drawing Sheet

HIGH PRESSURE PUMP FOR ELECTRO-RHEOLOGICAL FLUIDS

The invention described herein may be manufactured and used by or for the Government of the United States of America for governmental purposes without the payment of any royalties thereon or therefor.

BACKGROUND OF THE INVENTION

1. Field of the Invention

This invention relates to high-pressure pumps for electro-rheological fluids, and more particularly to pumps for such fluids which contain particulate matter in the range of 10 to 50 micron size.

2. Description of the Prior Art

As will be appreciated by those skilled in the art, electro-rheological fluids are slurries typically comprised of a non-conducting fluid and particulates. A typical slurry contains about 30% particulates and 6% water by eight mixed in a dielectric liquid. The application of a high-voltage electric field across a small gap filled with a electro-rheological fluid causes the water absorbed in the particulate to form induced dipoles which align the particles between the electrodes, resulting in an effective change in viscosity in the localized area between the electrodes. The particulates are normally on the order of 10 microns in diameter, and may be either hard or soft. Electro-rheological materials and some applications in which they are used are discussed in more detail in the literature, including the following articles, which are incorporated herein by reference.

*Cyanamid,* "Electro-Rheological Fluids", American Cyanamid Company, Wayne, New Jersey.

*Machine Design,* "Fluids That Thicken Electrically", by Theodore G. Duclos, Debra N. Acker and J. David Carlson, Thomas Lord Research Center, Lord Corporation, Cary, North Carolina; January 21,

*Phys. Technology,* Vol. 14 1983, The Institute of Physics, "Electrorheological Fluids" by J. E. Stangroom.

In general, pumps are used to build a high pressure in a hydraulic fluid. Positive displacement pumps such as gear pumps, IMO pumps, piston pumps, vane pumps, etc., are commonly used. These pumps all utilize close fitting components, typically steel components, to form cavities in which fluid is compressed to high pressures and discharged to a common manifold.

These pumps depend on close clearances of the components during operation using contaminant-free fluids. Systems in which such pumps are used are commonly filtered to remove particles larger than 10 microns because the pumps can be damaged by the ingestion of larger particles. Damage results typically from the contaminate scoring the surfaces of the close fitting components and causing excessive leakage.

SUMMARY OF THE INVENTION

An object of this invention is to expand existing pump technology to electro-rheologic fluids.

Another object of the invention is the provision of an electro-rheological pump that is contaminant insensitive for particles in the 10 to 50 micron size.

A further object is the provision of an electro-rheological pump that is compatible with existing pump technology.

One more object of this invention is the provision of a pump for electro-rheologic fluids that is able to produce flow smoothly without producing structure borne or fluid borne noise associated with positive displacement pumps.

Briefly, this invention contemplates a high-pressure pump for electro-rheological fluids in which the pump components operate with relatively large clearances and rely on the electro-rheological fluid effect for sealing. Preferably, the electro-rheological effect is induced in the fluid only in the region where a seal between relatively merging pump parts is required to generate a fluid pressure increase.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1B:
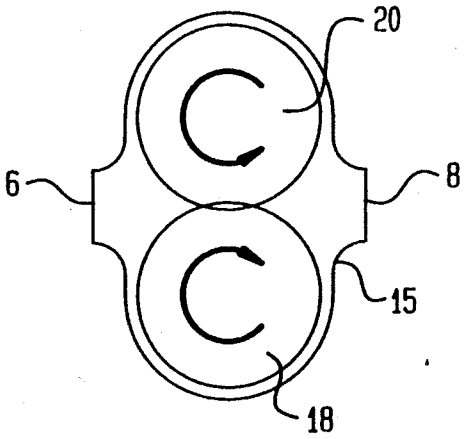
FIGS. 1A and 1B are schematic drawings of an electro-rheological pump in accordance with the teachings of this invention.
Figure 1A:
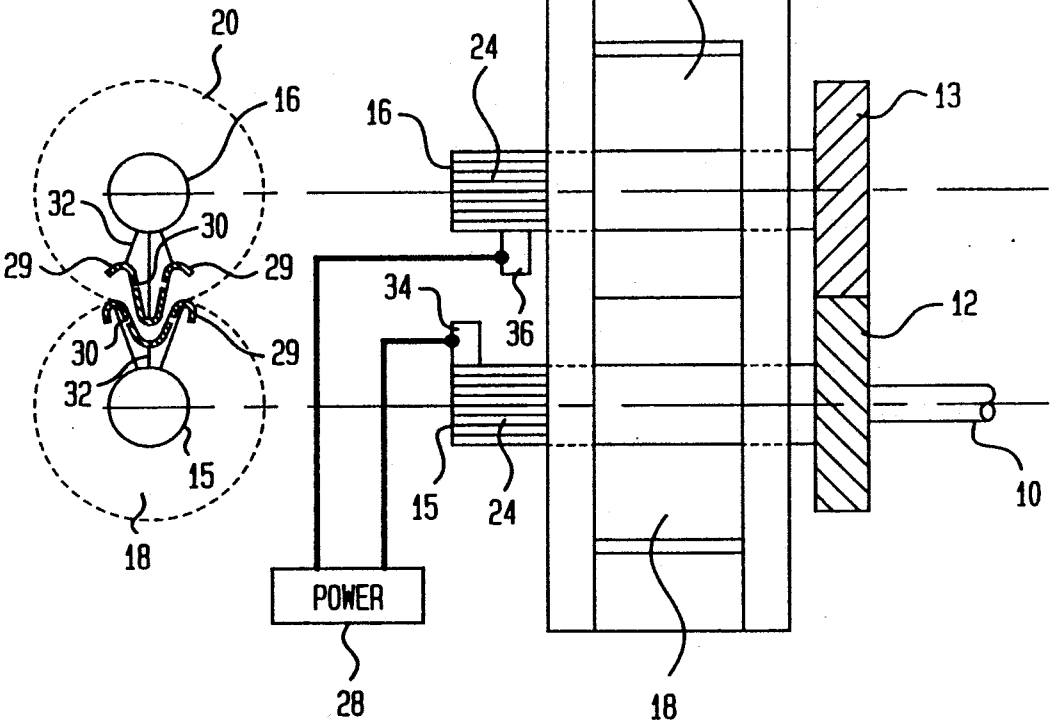

Referring now to FIG. 1 of the drawings, it shows a gear pump embodiment of the invention. The pump includes a housing 14, and a pair of pump gears 18 and 20 disposed in the housing between a low pressure inlet 8 and a high pressure outlet 6. In 15 this particular embodiment, a drive shaft 10, to which a suitable drive source is coupled (not shown), drives a meshed pair of drive/timing gears 12 and 13 that are mounted externally to a fluid tight housing 14. The drive/timing gears 12 and 13 are secured to shafts 15 and 16 respectively. One pump spur gear 18 is secured to shaft 15 and another pump spur gear 20 is secured to shaft 16. The gears 18 and 20 are arranged so that the teeth never contact one another but rather form a small gap at their closest point of approach where a tooth on one gear fits between two adjacent teeth of the other gear. The drive/timing gears 12 and 13 establish this close, non-contacting, running condition.

The shafts 15 and 16 in this embodiment extend beyond the housing 14 and each carries a series of electrically conducting commutating segments 24 about its periphery. Each of the teeth on the pump spur gears 18 and 20 is electrically conducting at least over its outer surface and each electrically conducting tooth is electrically isolated from the other teeth on that gear. Preferably, a conductive segment 29 extends partially over the surface of each tooth separated by narrow insulating spacers 30. Suitable connectors 32 respectively connect each commutator segment 24 to a respective conductive segment 29.

Brushes 34 and 36 are disposed to contact the commutating segments 24 on the shafts 15 and 16 respectively. Leads connect the brushes to a suitable voltage source 28. The brushes 34 and 36 are arranged so that they create a voltage gradient across the meshing gear teeth sufficient in strength to produce an electro-rheological effect in the electro-rheological being pumped. The voltage gradient between the two teeth of opposite polarity across the narrow gap where the teeth are meshing, locally increases the fluid viscosity, providing a local increase in fluid viscosity providing a seal between the teeth and allowing development of a high-pressure. Similar techniques can be used to seal pump rotors to the housing. For example, the teeth adjacent the housing can be selectively energized when in proximity of the housing wall. It should be noted that the viscosity of the electrorheological fluid is not increased throughout the entire system but only in a small region to form a seal on the pressure cavity.

While the invention has been described in terms of a single preferred embodiment, those skilled in the art will recognize that the invention can be practiced with modification within the spirit and scope of the appended claims. For example, the concepts of the invention can be applied to the rotor and idlers of an IMO pump and these concepts are also applicable to Vane and Piston pumps.

Having thus described our invention, what we claim as new and desire to secure by Letters Patent is as follows:

1. An apparatus for pumping an electro-rheological fluid, comprising in combination:

a pump housing having an inlet and an outlet;

a pair of relatively movable, non-contacting pump members disposed in said housing between said inlet and said outlet with a gap between said members;

means to drive at least one of said pair of relatively movable pump members relative to the other of said pair of relatively movable pump members to pump an electro-rheological fluid from a relatively low pressure at said inlet to a relatively high pressure at said outlet with said gap between said members located at an interface between said relatively low pressure and said relatively high pressure;

means to generate a voltage gradient across said gap to increase the viscosity of said electro-rheological fluid in order to create a seal between said relatively high pressure and said relatively low pressure;

said pair of relatively movable pump members are a pair of spur gears with non-contacting intermeshing teeth; and said means to generate a voltage gradient include commutating segments for connecting a voltage source to said non-contacting intermeshing teeth.

2. An apparatus for pumping an electro-rheological fluid as in claim 1, further including a pair of timing gears for driving said pair of spur gears.

* * * * *